US006167985B1

(12) United States Patent
Van Ligten

(10) Patent No.: US 6,167,985 B1
(45) Date of Patent: Jan. 2, 2001

(54) λ/4 ABSORBER WITH AN ADJUSTABLE BAND WIDTH

(75) Inventor: Robert Van Ligten, Zürich (CH)

(73) Assignee: Rieter Automotive (International) AG (CH)

( * ) Notice: Under 35 U.S.C. 154(b), the term of this patent shall be extended for 0 days.

(21) Appl. No.: 09/355,636

(22) PCT Filed: Feb. 4, 1998

(86) PCT No.: PCT/CH98/00041

§ 371 Date: Aug. 2, 1999

§ 102(e) Date: Aug. 2, 1999

(87) PCT Pub. No.: WO98/37541

PCT Pub. Date: Aug. 27, 1998

(30) Foreign Application Priority Data

Feb. 19, 1997 (CH) ..... 389/97

(51) Int. Cl.[7] ..... E04B 1/82

(52) U.S. Cl. ..... 181/286

(58) Field of Search ..... 181/293, 294, 181/295, 284, 285, 286, 288, 290, 210

(56) References Cited

U.S. PATENT DOCUMENTS

| | | | | |
|---|---|---|---|---|
| 4,160,491 | * | 7/1979 | Matsumoto et al. | 181/286 |
| 5,457,291 | * | 10/1995 | Richardson | 181/293 |
| 5,959,265 | * | 9/1999 | Van Ligten | 181/286 |
| 6,012,543 | * | 1/2000 | Shimpo et al. | 181/286 |

* cited by examiner

*Primary Examiner*—Khanh Dang
(74) *Attorney, Agent, or Firm*—Nath & Associates; Gary M. Nath; Harold L. Novick

(57) ABSTRACT

λ/4-absorber with an adjustable band width comprising at least one λ/4-resonator (2) whose opening region (4) comprises a perforated head part (5). A further development of this λ/4-absorber is provided with a soft and/or heat exchanging material (7) in the floor region (3).

12 Claims, 2 Drawing Sheets

Fig. 3a
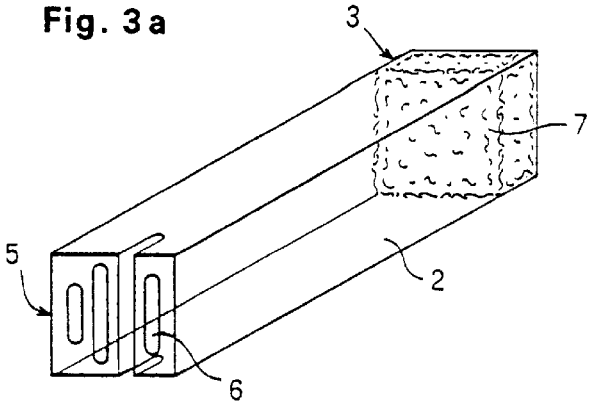
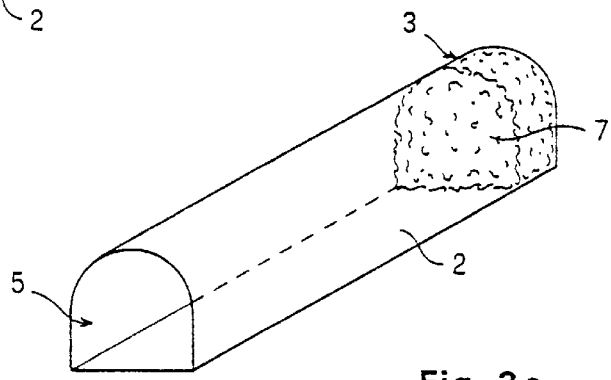
Fig. 3c
Fig. 3b
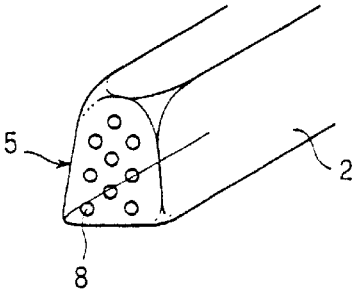
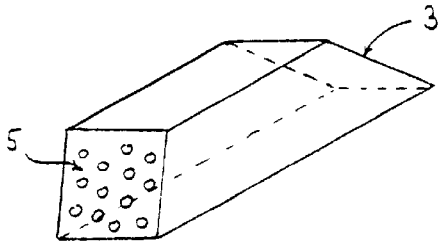
Fig. 3d
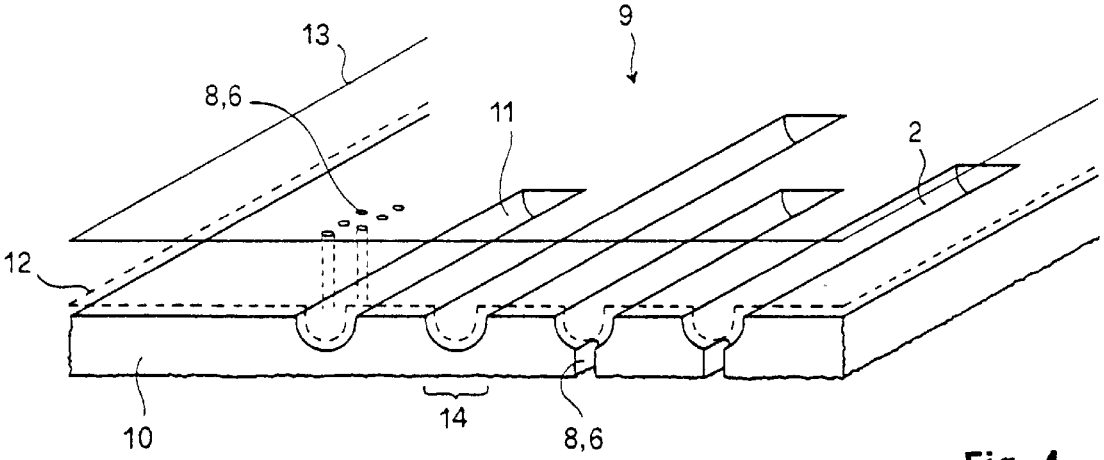
Fig. 4

λ/4 ABSORBER WITH AN ADJUSTABLE BAND WIDTH

BACKGROUND

The present invention relates to a λ/4-absorber for the absorption of sound as is produced by machines, in particular vehicles, with a multitude of tubular λ/4-resonators, whose opening borders on a sound reflecting surface.

1. Field of the Invention

It is the endeavour of the modern vehicle and machine industry to reduce or completely eliminate the noises emitted from either the machines or vehicles. For sound absorption today essentially mats of fibre insulation material or open-pore foams are employed which are laid around the sources of noise or are mounted in the direct vicinity of these. Their application however is restricted in heavily contaminated environments, since these open-pore materials rapidly accumulate with oil, water or dust and thus their sound absorbing effectiveness is lost.

It is also known to construct sound absorbers of a multitude of variously dimensioned Helmholtz resonators. Such Helmholtz absorbers have not proven themselves in practice for various reasons. In particular such Helmholtz absorbers are difficult to dimension and/or to manufacture and are not suitable for use in heavily contaminated environments.

For this reason there have already been put forward sound absorbers which consist of a multitude of tubular resonators. These tubular resonators may be mounted in a manner such that occuring contaminations or moisture may not get captured the rein. Furthermore these tubular resonators differ from Helmhholz resonators in their acoustic functioning manner and are known to the expert under the name λ/4-resonators.

This difference lies essentially in the simultaneously occuring mass and compressibility of the air in the resonator and in particular may be recognized in that with λ/4-resonators the resonant frequency is directly determined by the standing wave, whose wavelength is a quarter of the length of the tubular resonator, whilst the acoustic functioning manner and resonance of Helmholtz resonators must be described and determined by a spring-mass system.

2. Description of the Prior Art

GB 2 038 410 describes an acoustically effective lining for airplane engines, in which a multitude of Helmholtz absorbers are combined with λ/4-resonators. These resonators are grouped as tightly as possible in order to achieve a maximum in absorption capability. The sound openings of these resonators are covered with a perforated metal sheet or with a nonwoven fiber (having a relatively high acoustic resistance) in order to improve the acoustic connection to the outer sound field. Furthermore, it is suggested to acoustically connect the inidividual hollow bodies by means of perforations. This arrangement has the same effect as classical Helmholtz resonators, which all dissipate the sound energy internally.

DE 94 08 118 discloses a sound absorber with a plurality of tubular shaped recesses or channels which are inserted into a porous absorbant material. The openings of the individual λ/4-tubes are covered with a porous foam, a nonwoven fiber or a thin foil. In a preferred embodiment the cavities are totally or partially filled with a further sound absorbing material.

With practical embodiments of Helmholtz resonators, many assumptions which are made for the advance calculation of the resonant frequency may not be realised. Thus for example the walls of Helmholtz resonators may not be constructed so stiffly that these do not deform on pressure fluctuations on resonance, or the mass of air in the throat region of the Helmholtz resonators may not be exactly determined. The advantages of λ/4-resonators with respect to Helmholtz resonators lie thus essentially in the more exact determination in advance of the absorption effect, their lower danger of contamination and their more simple dimensioning and manufacture.

Such a λ/4-absorber is for example described in WO 96/23294 and comprises a multitude of tubular resonators, whose sound openings border on a surface in such a manner that the interaction zones (in which the impinging sound wave and the standing waves formed in the individual resonators interfere destructively) of the individual resonator openings are distributed covering as much surface as possible and at the same time do not considerably overlap. Such λ/4-resonators fundamentally absorb in a narrow frequency range about their resonant frequency $f_o$. The width of this frequency range is dependent on the quality factor Q of the resonators or on the size of the energy losses which occur on resonance. λ/4-absorbers, as is described in this WO 96/23294, may be embedded in any dense-bodied, reverberant material such as for example metal, plastic, ceramic or glass. With practical application of these absorbers, in particular when a wider frequency band is to be achieved with a multitude of resonators, it is important to be able to influence the energy losses in a simple manner. With certain embodiment forms e.g deep-drawn semi-tubes which are completed with a plate, the energy losses are very small, i.e. the Q-factor and the terminating impedance are very high. This leads to undesired narrow resonance absorption curves.

SUMMARY OF THE INVENTION

It is therefore the aim of the present invention to be able to manufacture acoustically highly effective λ/4-absorbers with an adjustable band width in a simple manner.

According to the invention this is achieved by a λ/4-absorber. In particular it is provided either for increasing the acoustic impedance $Z_{open}$ in the opening region of the λ/4-resonators by way of a perforated head part, or to produce additional energy losses in the floor region by applying soft and/or heat-exchanging material, thus in order to reduce $Z_T$. This may be achieved in that in the floor region of the resonators, where the pressure fluctuations are very large, a heat sink with a large contact surface for air is provided. Such a heat sink is produced by any material which can take up and carry off heat from the temperature fluctuations of the air produced by pressure fluctuation. The man skilled in the art in the field of noise protection has adequate knowledge of such materials. Another practical possibility is seen in the use of a stopper from closed-pore viscoelastic foam.

Another possibility lies in creating energy losses in the opening region by way of incorporating a—low—airflow resistance, e.g. a "grid". With the embodiment form of a deep-drawn foil and cover plate, such a "grid" may be produced in that one does not remove the end to be opened, but only perforates it.

It has been surprisingly proven that by restricting the airflow in the opening region of the λ/4-absorber, its absorption capability is not fundamentally reduced, but rather by way of this, an absorption with a larger band width of the frequency response may be achieved.

The present invention thus permits for the first time efficient λ/4-absorbers to be manufactured industrially, i.e.

inexpensively. Furthermore the present invention also permits the design of multifrequency absorbers in a simple manner in that, for forming a wider resonant frequency band, several differently dimensioned λ/4-resonators with an increased sound energy loss according to the invention in the opening region and/or the floor region are combined.

In the following the invention is explained in more detail by way of the figures and with the help of embodiment examples. With this there are shown:

DESCRIPTION OF THE SEVERAL VIEWS OF THE DRAWINGS

FIG. 3*a*: a view of a first embodiment form of a resonator with a slotted head part for the λ/4-absorber according to the invention;

FIG. 3*b*: a view of a second embodiment form of a resonator with a slotted head part for the λ/4-absorber according to the invention;

FIG. 3*c*: a view of a further embodiment form of a resonator with a heat exchanging material in the floor part for the λ/4-absorber according to the invention;

FIG. 3*d*: a view of a particular embodiment of a resonator in which the opening region and the floor region are tilted towards each other;

FIG. 4 a cross section of a practical embodiment form of the λ/4-absorber according to the invention.

DETAILED DESCRIPTION OF THE INVENTION

Figure 1:
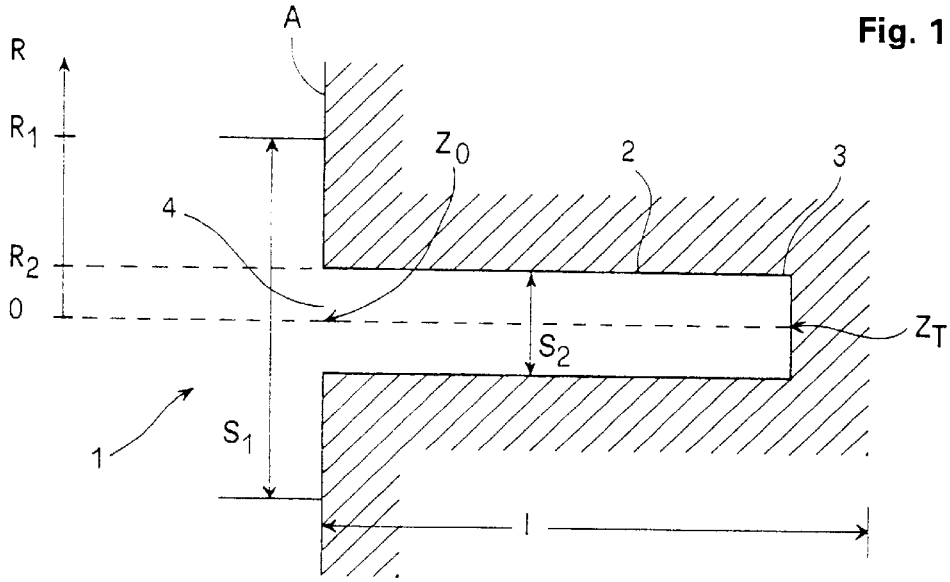
FIG. 1: a pictorial schematic for the functioning manner of the λ/4-resonators.

The principle manner of functioning of the λ/4-absorber 1 according to the invention is to be described in more detail by way of FIG. 1. From this figure it can be deduced that the opening of the λ/4-resonator 2 lies in a sound reflecting surface A. In the following, the characteristic impedance of the air is to be indicated at $Z_o$. The acoustic impedance in the floor region 3 is indicated at $Z_T$ in the following and comprises in this simplified model all sound energy losses in the inside of the resonator, (wherein $Z_T$ is proportional to the quality factor Q). For a given length 1 and a given cross sectional surface $S_2$ of the λ/4-resonator 2 there is formed on the reflecting surface A an interaction zone $S_1$ in which the impinging sound wave destructively interferes with the standing wave formed in the resonator 2. This interaction zone $S_1$ is also known as the "equivalent absorption surface". With a 100% absorption the acoustic impedance in the region of the interaction zone $S_1$, will essentially correspond to the characteristic impedance $Z_o$ of the air. If one assumes that in the case of a 100% absorption in the opening region 4 of the λ/4-resonator 2, the sound pressure and the particle flow are continuous, the following simple equation may be contructed:

$$S_1/S_2=Z_T/Z_o$$

This applies, as is shown in the mentioned WO 96/23294, not only for resonators standing perpendicular to the surface but likewise also just as well for resonators incorporated on or into this surface. If this equation is not fulfilled, there is no 100% absorption, i.e. there is a reflection which is either dominated by reflections on the reflecting surface A or by reflections on the resonator floor 3. If one wishes to design an absorber 1 with a high absorption capability then $S_1$, $S_2$ and $Z_T$ are not freely selectable and must be tuned to one another. Furthermore the desired band width of the frequency response determines the value of $Z_T$. As a result it is important to be able to adjust $Z_T$ and thus the energy losses in the resonator in the desired manner. According to the invention this may be achieved by applying soft, i.e. viscoelastic, closed-pore foams or other heat exchanging materials in the floor region of the λ/4-resonators, wherein all materials may be selected which with high pressure fluctuations lead to energy dissipations.

If for example one takes a resonator 2 for which the surface ratio $S_1/S_2=25$ then there results for a 100% absorption an impedance ratio $Z_T/Z_o=25$. Since $Z_O$corresponds to the characteristic impedance of air, that is having a value of approx. 400 Ns/m$^3$, the required acoustic impedance $Z_T$ in the floor region is approx. 25×400 Ns/m$^3$. Unfortunately such high impedance values today can be realised with only difficulty.

The present invention moreover makes use of the fact that at the resonant frequency, the following relationship applies for the impedance ratio $Z_T/Z_o$ in the floor region 3 and the impedance ratio $Z_o/Z_{open}$ in the opening region:

$$Z_T/Z_O=Z_o/Z_{open}$$

This leads to the surprising insight that in place of an increase of the energy losses in the floor region 3 of the λ/4-resonator, just as well, the energy losses in the opening region 4 thereof may be increased. For the above example in which $S_1/S_2=25$ is selected, there thus results an impedance ratio $Z_o/Z_{open}=25$, or $Z_{open}=1/25\times Z_o=1/25\times 400$ Ns/m$^3$. This value corresponds roughly to the flow resistance or the acoustic impedance of a wide-meshed grid (flying grid) and thus may be realised in a simple manner, i.e. industrially.

Basically however one could create the desired energy dissipations at each location of the resonator by way of incorporating suitable airflow resistances.

Figure 2A:
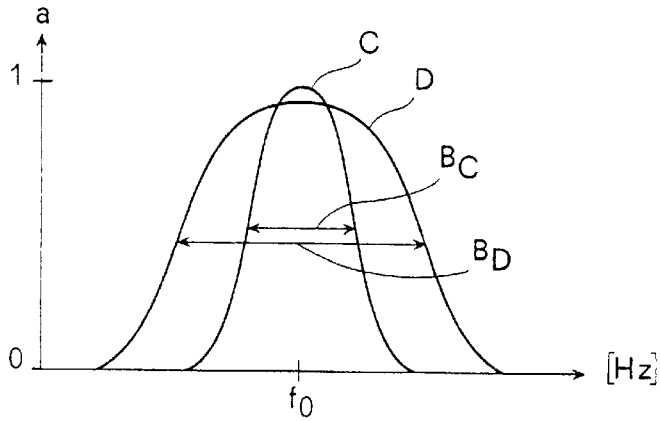
FIG. 2*a*: a diagram for the absorption behaviour of the λ/4-absorber according to the invention.

These considerations may be confirmed by experimental measurements as are shown in FIG. 2*a*. Curve C in FIG. 2*a* shows the frequency response of a 84 mm deep λ/4-absorber having a 14 mm inner diameter with a surface ratio of $S_1/S_2=50$, and which does not comprise means for increasing the sound energy loss. The frequency response or the absorption characteristic of this resonator has a band width $B_C$ of only 5.1%

Curve D in FIG. 2*a* represents the frequency response of an acoustically optimised λ/4-absorber according to the invention. With this absorber the surface ratio $S_1/S_2=25$ and the absorption characteristic has a band width of approx 11%.

This curves make clear that by changing the airflow resistance or the acoustic impedance in the opening region 4 and/or in the floor region 3 of the resonator 2, the frequency response width B may be influenced and at the same time an almost 100% absorption can be realised.

Figure 2B:
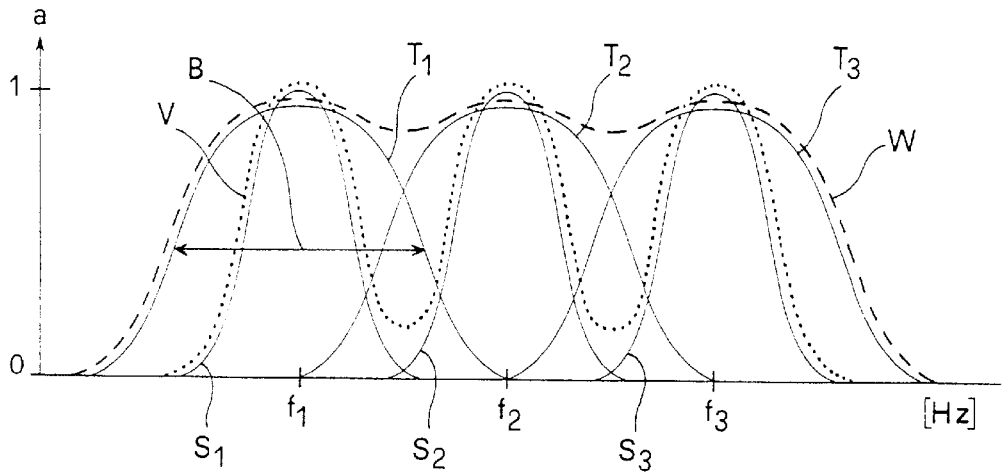
FIG. 2*b*: a diagram for the absorption behaviour of the multifrequency absorber according to the invention.

FIG. 2*b* makes clear the absorption behaviour of the multifrequency absorber according to the invention. With the use of conventional λ/4-resonators (narrow band absorbers) with differing resonant frequencies there is displayed an absorption behaviour as is represented by way of curve V. The curve V results from the sum of the absorption characteristics $S_1$, $S_2$, and $S_3$ produced by the individual narrow band absorbers. This curve V clearly shows the disadvantage of the multifrequency absorbers made with conventional narrow band absorbers. This curve follows the frequency response of the individual narrow band absorbers and falls strongly between the corresponding resonant frequencies $f_1$, $f_2$ and $f_3$, i.e. displays a poor absorption in this intermediate region. In contrast to this it is possible with the λ/4-absorbers according to the invention to provide a wide absorption band W with a constantly high absorption capability. From FIG. 2*b* it is clear that the λ/4-absorbers according to the invention comprise a larger band width B compared to the conventional narrow band absorbers. With multifrequency absorbers this leads to considerable overlappings of the absorption characteristics $T_1$, $T_2$ and $T_3$ of the individual λ/4-absorbers in the regions lying between the individual resonant frequencies $f_1$, $f_2$ and $f_3$. These overlappings cause the sum W of the absorptions $T_1$, $T_2$ and $T_3$ produced by the individual absorbers according to the invention to leads to an almost 100% absorption also in the region between the resonant frequencies $f_1$, $f_2$ and $f_3$. The curve W shows this clearly. With this it is also clear that with the λ/4-absorbers according to the invention there may be created multifrequency absorbers with any desired absorption characteristic.

FIGS. 3*a*, 3*b* and 3*c* show embodiment forms of the λ/4-absorber according to the invention. From FIG. 3*a* it can be seen that the resonator 2 comprises a head part 5 in which there are incorporated a multitude of perforations, in particular slots 6. Instead of such a head part 5 or complementary to such, according to the invention in the floor region 3 of the resonator a soft or heat exchanging material 7 may be incorporated (FIGS. 3*a*, 3*c*). In a further formation of the grid-like head part 5, instead of slot-like perforations 6 also holes 8 may be provided (FIG. 3*b*). The geometric form of the resonator 2, the choice of heat exchanging material 7 and the shape, dimensioning and number of perforations 6, 8 lie within the scope of the activity of the man skilled in the art. FIG. 3*d* shows a particular embodiment, in which the λ/4-resonator is formed as a hollow body with two trapezoidal lateral surfaces. This leads to a tilting towards each other of the opening area of the opening region 4 and of the bottom area of the floor region 3. Thus, for example, the area of the floor region 3 can be enlarged in a predetermined manner, thereby influencing its dissipative effectiveness. The opening area of the opening region 4 can be tilted in the same manner. As suitable energy dissipating materials 7, those materials are to be considered which relative to air have a large heat capacity and a large as possible surface area, such as for example open-pore foam with small cells, wool-like fibre material, grainy material or porous ceramic material. As soft materials, closed-pore, viscoelastic foams or other materials are considered, these dissipating energy with high pressure fluctuations.

FIG. 4 shows another multifrequency absorber, which may be realised industrially in a simple manner, having a multitude of differently dimensioned resonators 2. In a preferred embodiment form this comprises a carrier layer 10 manufactured from fibrous fleece or foam, into which tubular deepenings are formed. These tubular deepenings 11 may be coated with an adhesive layer 12 in order on the one hand to close the pores of the carrier layer 10 in this region, and on the other hand to fasten a cover foil 13 onto this carrier layer 10. The holes 8 or slots 6, according to the invention, may be incorporated into this cover foil 13. For certain applications it is also foreseen, instead of providing the formed carrier layer 10 with a cover foil 13, to mount it on a rigid outer shell, e.g. a motor bonnet and to incorporate the perforations 8, 6 in the shaped region 14 of the carrier layer 10.

The λ/4-absorbers according to the invention may be industrially manufactured in a simple manner. In particular they may be extruded in the known manner, for example produced as extruded plates with tube-like deepenings which are covered by a second plate. According to the field of application, these absorbers according to the invention may also be produced with the help of cold-drawing or injection moulding technology. In a further manufacturing formation, corrigated-cardboard-like material into which the perforations according to the invention are incorporated may be employed.

It is to be understood that for the respective applications, the λ/4-resonators according to the invention may be dimensioned in a suitable manner and/or differently dimensioned λ/4-resonators may be combined with one another for forming a wide band absorber. It is also to be understood that the resonators according to the invention may be manufactured and applied individually, in groups with resonators of a same type (monofrequency absorbers), or in groups with differently dimensioned resonators (multifrequency absorbers). Of course the absorbers according to the invention may also be combined with conventional fibery or foamed absorbers and in particular be so tuned that these in the region of the falling away of the absorption, are effective against lower frequencies. Their preferred application lies particularly in absorption components on motor bonnets, on end walls and wheel cases, in particular on the motor side, on roofings, door panelling or door cavities and boot lids, in delivery or goods vehicles, in the loading region, on roofs or on walls. It is to be understood that these absorbers may also be applied in building construction and highway engineering, in particular on the walls and ceilings of living and working rooms, in factory workshops, in sports halls, tunnels or on sound shielding along roads or railway lines.

I claim:

1. A λ/4-absorber for the absorption of sound, such as is generated by machines, in particular by vehicles, comprising:

a plurality of tubular λ/4-resonators wherein each λ/4-resonator has an opening region having a plurality of spaced apart openings which border on a sound reflecting surface;

a plurality of interaction zones corresponding to each of said plurality of spaced apart openings, wherein an impinging sound wave destructively interferes with a standing sound wave formed in said λ/4-resonator, and wherein said plurality of interaction zones are distributed to cover a sound reflecting surface and each of said plurality of interaction zones does not significantly overlap another of said plurality of interaction zones;

wherein a band width of a resonant frequency response of said λ/4-resonators can be adjusted by a first means for changing a sound energy loss in said opening region, said first means having a low air flow resistance approximately equivalent to that of a wide-meshed grid.

2. A λ/4-absorber according to claim 1, wherein said first means for changing said sound energy loss in said opening region further comprises a head part having a plurality of slot-shaped perforations.

3. A λ/4-absorber according to claim 1, wherein said first means for changing said sound energy loss in said opening region further comprises a head part having a plurality of hole-shaped perforations.

4. A λ/4-absorber according to claim 1, wherein said first means for changing said sound energy loss in said opening region further comprises a grid-like head part.

5. A λ/4-absorber according to claim 2, wherein said head part is an integral component of said λ/4-absorber.

6. A λ/4-absorber according to claim 1, further comprising a second means for changing said sound energy loss disposed in said floor region of said /4-resonator.

7. A λ/4-absorber according to claim 6, wherein said second means for changing said sound energy loss further comprises a soft material disposed in said floor region of said resonator.

8. A λ/4-absorber according to claim 1, wherein said opening region and said floor region are tilted towards each other.

9. A multifrequency absorber comprising the λ/4-absorber as claimed in claim 1.

10. A monofrequency absorber comprising the λ/4-absorber as claimed in claim 1.

11. A λ/4-absorber according to claim 6, wherein said second means for changing said sound energy loss further comprises a heat exchanging material disposed in said floor region of said resonator.

12. A λ/4-absorber according to claim 6, wherein said second means for changing said sound energy loss further comprises a soft and heat exchanging material disposed in said floor region of said resonator.

* * * * *